US008141339B2

(12) United States Patent
Fang et al.

(10) Patent No.: US 8,141,339 B2
(45) Date of Patent: Mar. 27, 2012

(54) INJECTOR ASSEMBLY HAVING MULTIPLE MANIFOLDS FOR PROPELLANT DELIVERY

(75) Inventors: James J. Fang, Chatsworth, CA (US); Steven C. Fisher, Simi Valley, CA (US); Robert J. Jensen, Thousand Oaks, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 285 days.

(21) Appl. No.: 12/613,605

(22) Filed: Nov. 6, 2009

(65) Prior Publication Data

US 2010/0043391 A1 Feb. 25, 2010

Related U.S. Application Data

(62) Division of application No. 11/237,473, filed on Sep. 28, 2005, now Pat. No. 7,640,726.

(51) Int. Cl.
*F02K 9/00* (2006.01)

(52) U.S. Cl. ..... 60/258; 60/739

(58) Field of Classification Search ..... 60/257, 60/258, 259, 739, 740
See application file for complete search history.

(56) References Cited

U.S. PATENT DOCUMENTS 3,098,353 A 7/1963 Abild
3,128,601 A 4/1964 Abild
3,675,425 A * 7/1972 Scannell et al. ..... 60/258
3,702,536 A 11/1972 Gregory
3,740,946 A 6/1973 Welton et al.
4,722,181 A * 2/1988 Yu ..... 60/776
6,185,927 B1 * 2/2001 Chrones et al. ..... 60/258
6,964,154 B1 11/2005 Sackheim et al.

OTHER PUBLICATIONS

Bazarov, Prof. Vladimir G.; Perspectives of Liquid Rocket Engine Evolution: Ability to Wide Smooth Thrust Variation; Moscow State Aviation Institute, Russia, 11 pages.

* cited by examiner

*Primary Examiner* — Louis Casaregola
(74) *Attorney, Agent, or Firm* — Carlson Gaskey & Olds PC

(57) ABSTRACT

There is provided an injector assembly having two or more oxidizer manifolds and/or two or more fuel manifolds for delivery of liquid propellants to a combustion chamber such that combustion instability is reduced or eliminated during throttling. Delivery of the oxidizer to the oxidizer manifolds is controlled by an oxidizer valve, which may comprise an integral valve. The oxidizer passes from the oxidizer manifolds into the oxidizer element and then into the combustion chamber. The multiple oxidizer manifolds allow the oxidizer to be provided through selective openings of the oxidizer element thus reducing the change in pressure drop across the oxidizer element to thereby reduce or eliminate combustion instability and other problems. Additionally, the injector assembly may also include a lift-off seal or a filler fluid source to fill any temporarily unused oxidizer manifolds with an oxidizer or filler fluid.

11 Claims, 4 Drawing Sheets

INJECTOR ASSEMBLY HAVING MULTIPLE MANIFOLDS FOR PROPELLANT DELIVERY

REFERENCE TO RELATED APPLICATIONS

This application is a divisional of U.S. patent application Ser. No. 11/237,473, filed 28 Sep. 2005 now U.S. Pat. No. 7,640,726. The disclosure of the above application is incorporated herein by reference.

BACKGROUND

Embodiments of the present application are related to injector assemblies, and more particularly, to injector assemblies having multiple manifolds for selective delivery of propellants.

Rocket engines provide thrust to a rocket, spacecraft, or other devices or vehicles by burning a mixture of a fuel, such as kerosene, methane, or hydrogen to list non-limiting examples, and an oxidizer, such as oxygen to list a non-limiting example, in a combustion chamber. The fuel and oxidizer are delivered to the combustion chamber by an injector assembly and are then atomized, vaporized, mixed, and combusted in the combustion chamber. The fuel and oxidizer are commonly referred to as propellants. The rocket engine may be throttled up to provide more thrust or throttled down to provide less thrust by increasing or decreasing the amount of propellants provided to the combustion chamber of the rocket engine. The individual propellants are often stored and initially delivered as liquids. Typically, injector assemblies of rocket engines and other applications are configured to operate with only one type of fuel, thus limiting the number of refueling possibilities that may further limit the use of the injector assembly.

As shown in FIG. 1, which illustrates a typical coaxial element injector assembly 10, the injector assembly comprises a manifold 12 for the oxidizer and a manifold 14 for the fuel, wherein each manifold may have a valve upstream of the manifold to control the amount of propellants provided to each manifold through the oxidizer inlet 12A and the fuel inlet 14A. The propellants flow from the manifold into the combustion chamber 16 through several individual injector elements 18 that comprise both an oxidizer flow passage and a fuel flow passage. The oxidizer flow passage and the fuel flow passage may define a coaxial arrangement to provide mixing of the oxidizer and fuel. An injector assembly may include only one injector element or up to several hundred injector elements in a large assembly.

In order to minimize the likelihood of poor performance or poor combustion stability, a typical injector element will have a pressure drop of 10% to 20% of the combustion chamber pressure during normal operation. Problems with injector assemblies often arise when the rocket engine is throttled up or down a relatively large amount which changes the pressure drop across the injector elements. This change in pressure drop is created by the change in flow through the injector elements, and the change in pressure is proportional to the square of the relative amount of propellant flow through the injector elements. For example, if the flow of the propellant is decreased to one half (112) of the original flow, the pressure drop is reduced by one fourth (114) of the original pressure drop. Conversely, if the flow of the propellant is increased by three times, the pressure drop is increased by nine times.

If the pressure drop across the injector element is too low, atomization, vaporization, and mixing will be insufficient, thus leading to poor performance of the rocket engine. A low pressure drop across the injector element may also lead to combustion instability that may further lead to sudden failure of the rocket engine. If the pressure drop across the injector element is too high, an inordinate amount of energy is required to pump the propellant to the high pressure required to introduce flow into the injector assembly.

Therefore, a need exists for an injector assembly that maintains sufficient pressure drop when the injector is throttled a relatively large amount. In addition, the needed injector assembly would maintain good performance and protect from feed system coupled combustion instabilities without sacrificing the range of throttling available in conventional injector assemblies or exposing moving surfaces and dynamic seals to hot and/or corrosive reaction products.

BRIEF SUMMARY OF THE INVENTION

Embodiments of the present invention address the needs and achieve other advantages by providing an injector assembly that comprises at least two oxidizer manifolds with an oxidizer valve, such as an integral valve, to selectively provide an oxidizer to one or more of the oxidizer manifolds. The oxidizer element is in fluid communication with each of the oxidizer manifolds, whereby the oxidizer element defines openings through the oxidizer element wall that open into each oxidizer manifold. The injector assembly is throttled by selectively adjusting the amount of oxidizer provided to each oxidizer manifold by actuating the oxidizer valve. Additionally or alternatively, embodiments of the present invention provide an injector assembly that comprises at least two fuel manifolds with a fuel valve, such as an integral valve, to selectively provide fuel to one or more of the fuel manifolds. By providing multiple manifolds for delivery of the oxidizer and/or fuel, which ultimately affects the injector discharge coefficient, the injector assembly is able to achieve large changes in oxidizer and fuel flow without the undesirable large changes in pressure drop across the respective side of the injector. Moreover, the injector assembly is advantageously configured to avoid exposing moving surfaces and dynamic seals to hot and/or corrosive reaction products.

An injector assembly of one embodiment of the present invention for the delivery of propellants to a combustion chamber comprises an oxidizer element upstream of the combustion chamber and at least two oxidizer manifolds in fluid communication with the oxidizer element opposite the combustion chamber. Similarly the injector assembly comprises a fuel element upstream of the combustion chamber and at least one fuel manifold in fluid communication with the fuel element opposite the combustion chamber. An oxidizer valve is also included to selectively provide an oxidizer to one or more of the oxidizer manifolds. Therefore, the injector assembly may be throttled by selectively providing an oxidizer to one or more oxidizer manifolds and thus enabling change in the flow of the oxidizer through the oxidizer element without effecting an undesirable large change in pressure drop across the oxidizer element.

An additional embodiment of the present invention includes an injector assembly with at least two fuel manifolds to similarly enable changes in flow of the fuel without effecting an undesirable change in pressure drop across the fuel element. Further embodiments of the present invention include an oxidizer valve and/or a fuel valve that comprises an integral valve, oxidizer elements and fuel elements that are coaxial to one another, oxidizer elements and/or fuel elements that are swirl injectors, and oxidizer elements and/or fuel elements that have varying cross-sectional areas along the axial length of the oxidizer element. To prevent backflow into oxidizer manifolds and/or fuel manifolds that selectively are not providing an oxidizer or fuel, respectively, still further embodiments of the present invention include a lift-off seal that selectively engages the oxidizer valve and/or fuel valve to selectively allow a nominal amount of an oxidizer or fuel to bleed into each of the oxidizer manifolds and/or fuel manifolds.

Other aspects of the present invention also provide methods for operating an injector assembly without creating a significant change in pressure drop across the injector element. An oxidizer is delivered to two or more oxidizer manifolds and then provided to the combustion chamber through an oxidizer element. The amount of oxidizer delivered to the oxidizer manifolds is controlled by selectively actuating an oxidizer valve, such as an integral valve. Fuel is delivered to a fuel manifold and then provided to the combustion chamber through a fuel element to allow mixing of the oxidizer and fuel. The oxidizer and/or fuel are swirled in some embodiments of the present invention to facilitate mixing of the oxidizer and fuel. Alternative embodiments of the present invention may either provide a filler fluid (such as a vaporized form of the nominally liquid oxidizer) into at least one oxidizer manifold to which an oxidizer is selectively not delivered or move a lift-off seal proximate to the oxidizer valve to allow an oxidizer to bleed into at least one oxidizer manifold to which an oxidizer is selectively not delivered. Therefore, embodiments of the present invention provide apparatuses and methods for reducing or eliminating the undesirable change in pressure drop across an injector element previously associated with throttling of the injector assembly.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

At least three embodiments of the present invention will be described more fully with reference to the accompanying drawings. The invention may be embodied in many different forms and should not be construed as limited to only the embodiments described and shown. Like numbers refer to like elements throughout.

Figure 1:
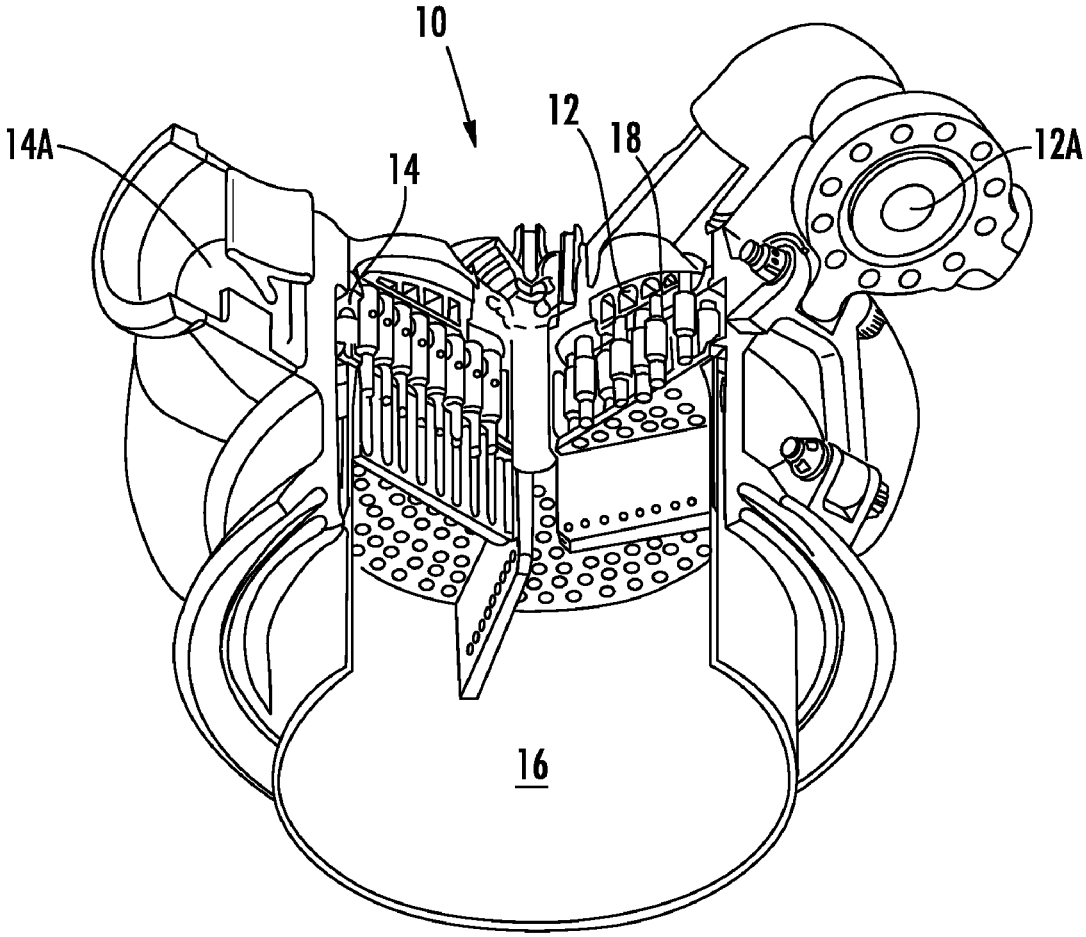
FIG. 1 (PRIOR ART)
FIG. 1 is a perspective side view of a conventional rocket engine, wherein the cut-away illustrates a single oxidizer manifold and single fuel manifold for each oxidizer element and fuel element, respectively.
Figure 2:
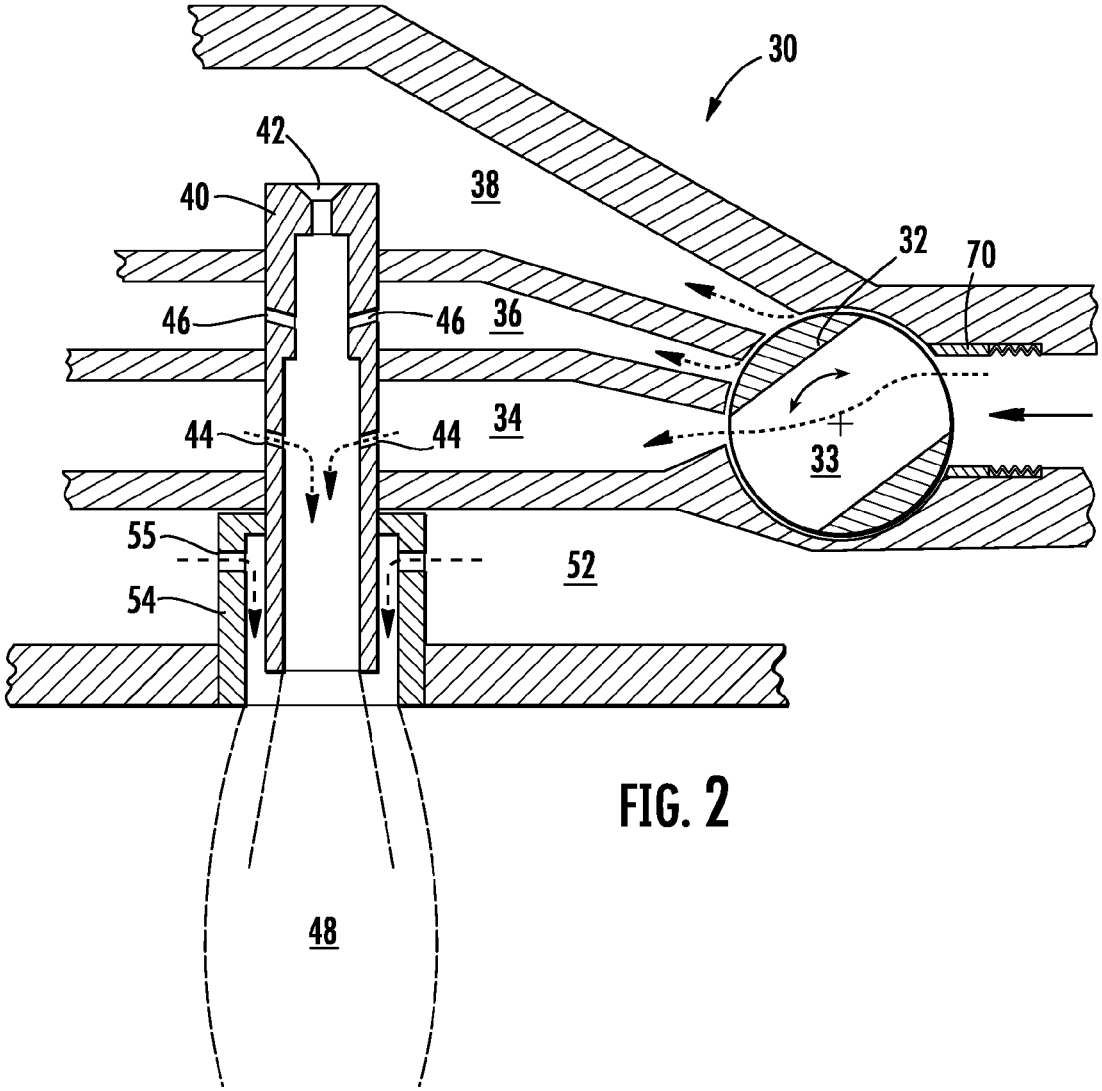
FIG. 2 is a descriptive side view of a rocket engine according to a first embodiment of the present invention, illustrating an injector assembly having three oxidizer manifolds, one fuel manifold, and an oxidizer valve with a lift-off seal in the unsealed position.
Figure 3:
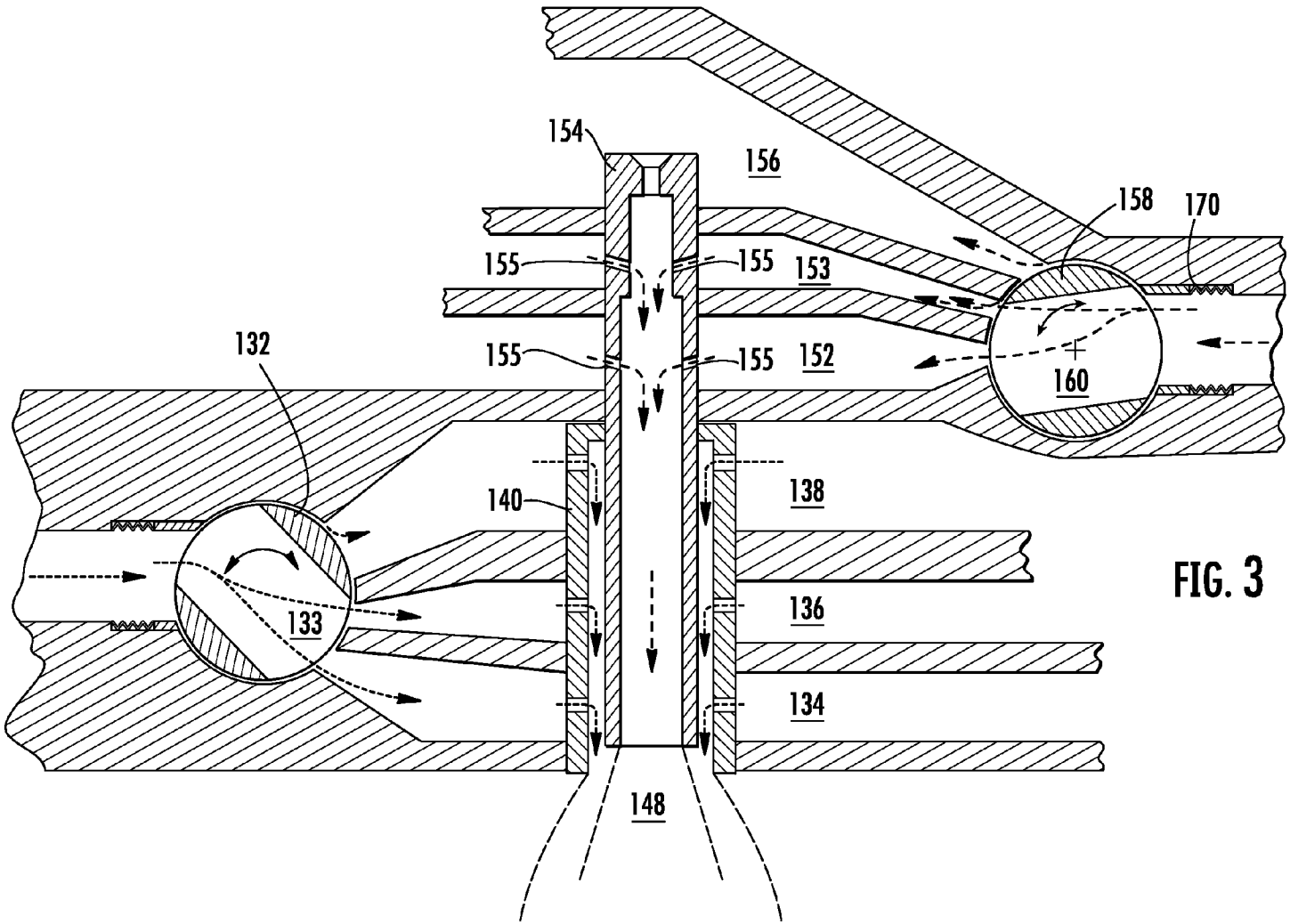
FIG. 3 is a descriptive side view of a rocket engine according to a second embodiment of the present invention, illustrating an injector assembly having three oxidizer manifolds, three fuel manifolds, and an oxidizer valve with a lift-off seal in the unsealed position.
Figure 4:
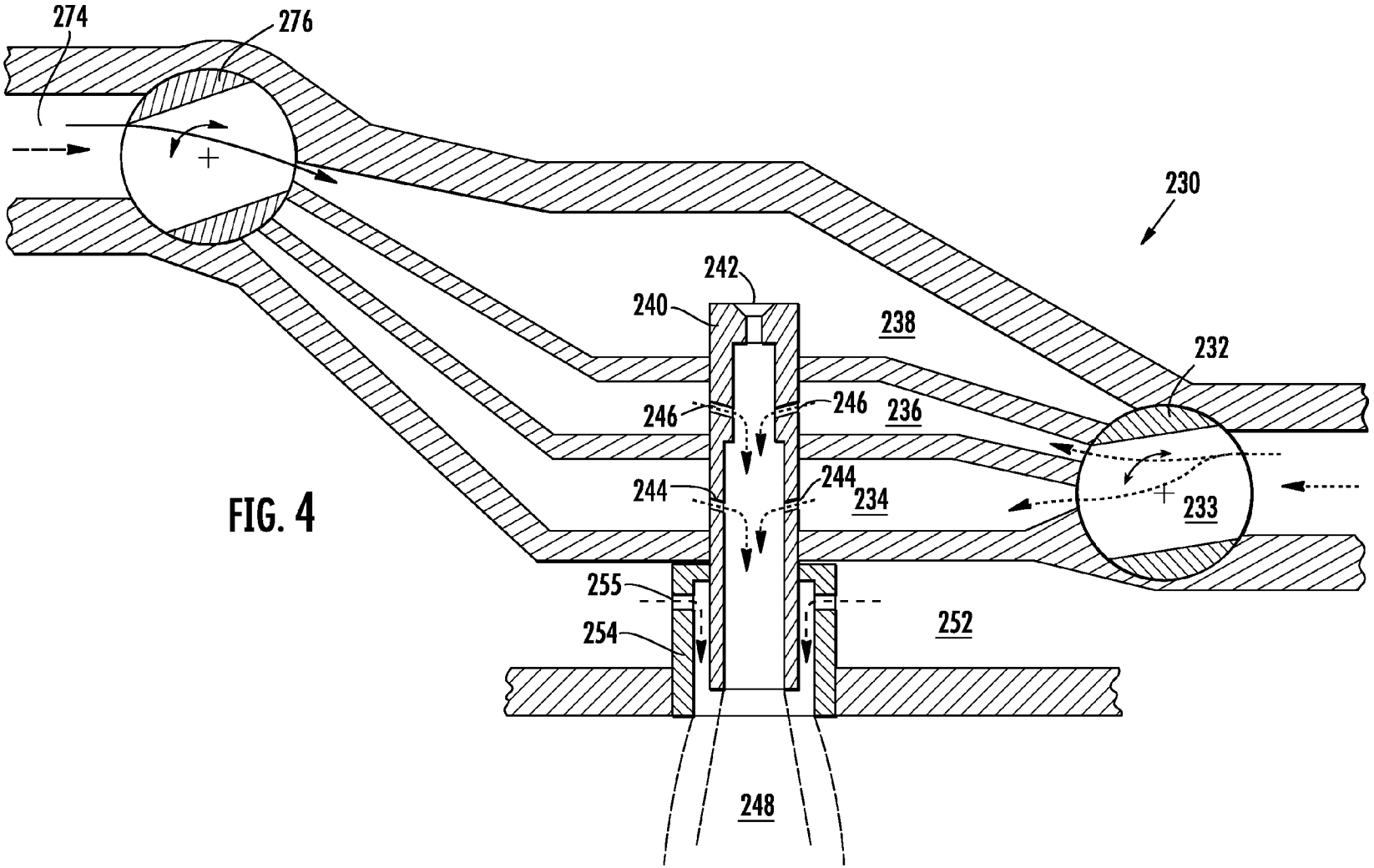
FIG. 4 is a descriptive side view of a rocket engine according to a third embodiment of the present invention, illustrating an injector assembly having three oxidizer manifolds, one fuel manifold, and a filler fluid source.

With reference to FIGS. 2-4, injector assemblies of various embodiments of the present invention are illustrated, wherein the injector assemblies are shown in rocket engines, for use with missiles and spacecraft, to list two non-limiting examples. Further embodiments of the present invention are used in other applications in which flow energy is converted into other forms of energy such as mechanical energy or electrical energy. A non-limiting example of an injector assembly of the present invention includes an injector assembly for a land-based gas turbine. Still further embodiments of the present invention use the injector assemblies to create a product gas, such as in the oil and chemical industries in which waste materials are mixed with other constituents to create a desired byproduct, to describe one non-limiting example. Referring again to the embodiments of FIGS. 2-4, the rocket engines provide thrust by combusting a mixture of oxidizer and fuel. The oxidizer used by the rocket engines of the various embodiments of the present invention may be any oxidizer delivered in any state, such as liquid oxygen to name on non-limiting example. Similarly, the fuel used by the rocket engines of the various embodiments of the present invention may be any fuel delivered in any state, such as hydrogen, methane, kerosene, or the like to list non-limiting examples of fuels. The rocket engines of the various embodiments of the present invention are capable of operating with various oxidizers and fuels, such that the rocket engine is not limited to using only one specific oxidizer or fuel.

The rocket engine 30 of FIG. 2 comprises an oxidizer valve 32 which controls delivery of the oxidizer, preferably from a stored container, into the two or more oxidizer manifolds 34, 36, and 38 of the rocket engine. The oxidizer valve 32 of FIG. 2 is servo controlled by a servo motor (not shown) that is controlled by either a processing element, such as a processor or other computing device, or by an operator, either directly or indirectly. As shown in FIG. 2, the oxidizer valve 32 defines a generally circular cross-section with a passage 33 therethrough, in which the passage is sized to allow an oxidizer to pass to all of the oxidizer manifolds 34, 36, and 38; however, further embodiments of the present invention may have alternatively shaped or sized valves and/or provide multiple valves to allow sufficient passage of an oxidizer to the oxidizer manifolds. Referring again to FIG. 2, the oxidizer valve 32 is illustrated in a position that allows an oxidizer to substantially pass only to the first oxidizer manifold 34; however, the oxidizer valve may also be positioned to allow an oxidizer to pass to both the first oxidizer manifold 34 and second oxidizer manifold 36 or to pass to the first, second, and third oxidizer manifolds 34, 36, and 38. Still further embodiments of the present invention include an oxidizer valve that allows passage of the oxidizer to only the third oxidizer manifold or to only the second and third oxidizer manifolds. The oxidizer valve 32 of FIG. 2 defines an integral valve such that the valve opens or closes an oxidizer manifold inlet substantially completely without maintaining a partially opened position for an oxidizer manifold. Further embodiments of the present invention include oxidizer valves that allow partial passage of an oxidizer, such as by rotating the passage to open only partially to the oxidizer manifold inlet, such as half open to allow approximately 50% of the oxidizer to pass relative to a fully open inlet. Still further embodiments of the present invention comprise an injector assembly comprising an integral valve and a variable valve, such as upstream of the integral valve, to control the flow of oxidizer. Additional embodiments of the present invention provide multiple oxidizer valves to control the delivery of oxidizer to the oxidizer manifolds.

Referring again to FIG. 2, the rocket engine 30 comprises three oxidizer manifolds 34, 36, and 38; however, further embodiments of the present invention may comprise additional oxidizer manifolds based upon performance requirements. The oxidizer element 40 of the rocket engine 30 defines an axial length sufficient to be in fluid communication with all of the oxidizer manifolds. The oxidizer manifolds 34, 36, and 38 of FIG. 2 are in fluid communication with the oxidizer element 40 and are configured to deliver an oxidizer to the oxidizer element. It should also be noted that rocket engines of various embodiments of the present invention may include one or more, such as several hundred, oxidizer elements and may include one or more oxidizer valves. Some embodiments of the present invention comprising multiple oxidizer valves preferably control the oxidizer valves to operate synchronously; however, !%her embodiments control the oxidizer valves independently.

The oxidizer element 40 of FIG. 2 defines an axial length sufficient to be in fluid communication with the oxidizer manifolds 34, 36, and 38. The oxidizer element 40 comprises a top opening 42 through which an oxidizer from the third oxidizer manifold 38 enters the oxidizer element. The top opening 42 is defined in the axial end of the oxidizer element 40 and defines a central axis that is substantially coaxial with the axis of the oxidizer element. Further embodiments of the rocket engine define two or more top openings and/or side openings through which an oxidizer from an oxidizer manifold enters. The oxidizer element 40 of FIG. 2 also includes a first set of openings 44, such as four openings equally spaced in a circumferential direction, that are defined along the perimeter of the oxidizer element at an axial location proximate the first oxidizer manifold 34 such that an oxidizer from the first oxidizer manifold enters the oxidizer element through the first set of openings. Similarly, the oxidizer element 40 of FIG. 2 also includes a second set of openings 46 that are defined along the perimeter of the oxidizer element at an axial location proximate to the second oxidizer manifold 36 such that an oxidizer from the second oxidizer manifold enters the oxidizer element through the second set of openings. Further embodiments of the rocket engine define oxidizer elements having sets of openings in fluid communication with respective oxidizer manifolds, wherein the sets of openings define any number of openings, including only one opening, depending upon the size and positioning of the openings comprising a set of openings.

The oxidizer element 40 of FIG. 2 comprises a post injector having at least one opening to one or more of the oxidizer manifolds 34, 36, and 38 such that the axis of the opening defines an axis that is generally radial relative to the axis of the oxidizer element. Therefore, the oxidizer that enters the oxidizer element 40 from the oxidizer manifolds 34, 36, and 38 will flow axially through the oxidizer element in a generally steady flow thus creating an oxidizer-fuel interface proximate to the axial end of the oxidizer element closest to the combustion chamber 48, whereby the interface causes the oxidizer and fuel to mix a sufficient amount for combustion purposes. Further embodiments of the rocket engine, such as the rocket engine 230 of FIG. 4, provide an oxidizer element 240 that comprises a post injector that further defines a swirl injector having at least one opening to one or more of the oxidizer manifolds 234, 236, and 238, wherein the opening defines an axis that is generally tangential relative to the axis of the oxidizer element. The generally tangential orientation of the set of openings 244 and 246 creates a swirl of the oxidizer as the oxidizer flows in a generally axial direction which atomizes the oxidizer prior to the oxidizer mixing with the fuel.

Referring again to the oxidizer element 40 of FIG. 2, to reduce or eliminate backflow through the oxidizer element, the oxidizer element defines a variable cross-sectional area along the axial length of the oxidizer element. The oxidizer element 40 defines a step 50 generally between the first oxidizer manifold 34 and the second oxidizer manifold 36 to reduce the possibility of backflow in a direction away from the combustion chamber 48. Similarly the flange around the top opening 42 at the axial end of the oxidizer element 40 similarly provides a step to reduce the possibility of backflow. Therefore, the oxidizer element 40 of FIG. 2 defines a cross-sectional area that generally increases as the oxidizer element extends axially from the oxidizer manifolds 34, 36, and 38 to the combustion chamber 48. Further embodiments of the present invention provide an oxidizer element that defines a cross-sectional area that alternatively increases and decreases as the oxidizer element extends axially from the oxidizer manifolds to the combustion chamber or that define a generally consistent cross-sectional area along the entire axial length of the oxidizer element.

Referring again to FIG. 2, the rocket engine 30 also comprises a fuel manifold 52 into which a fuel is delivered. The fuel manifold 52 is in fluid communication with a fuel element 54 and is configured to deliver fuel to the fuel element. The combination of the oxidizer element 40 and the fuel element 54 defines the injector element of the rocket engine 30. A fuel valve (not shown) is provided for controlling the delivery of fuel to the fuel manifold 52. The injector assembly of the rocket engine 30 is defined by the oxidizer manifolds 34, 36, and 38, the fuel manifold 52, the oxidizer valve 32, the fuel valve, and the injector element. Further embodiments of the present invention, such as the rocket engine 130 of FIG. 3, comprise two or more fuel manifolds 152,153, and 156 and a fuel valve 158 that defines a passage 160 to provide fuel to the fuel element 154 in a similar fashion as the oxidizer valve 32 of the rocket engine 30 of FIG. 2 delivers an oxidizer to the oxidizer element 40. The fuel valve 158 of FIG. 3 defines an integral valve such that the valve opens or closes a fuel manifold inlet substantially completely without maintaining a partially opened position for a fuel manifold. Further embodiments of the rocket engine include fuel valves that allow partial passage of fuel, such as by rotating the passage to open only partially to the fuel manifold inlet, such as half open to allow approximately 50% of the fuel to pass relative to a fully open inlet. Still further embodiments of the present invention comprise an injector assembly comprising an integral valve and a variable valve, such as upstream of the integral valve, to control the flow of fuel. Additional embodiments of the present invention provide multiple fuel valves to control the delivery of fuel to the fuel manifolds.

Turning now to the fuel element 54 of the rocket engine 30 of FIG. 2, the fuel element, which like the oxidizer element 40 is upstream of the combustion chamber and downstream of the respective manifold, defines a set of openings 55, such as four openings equally spaced in a circumferential direction, that are defined along the perimeter of the fuel element at an axial location proximate the fuel manifold 52 such that fuel from the fuel manifold enters the fuel element through the set of openings, similar to the sets of openings of the oxidizer element 40. The fuel element 54 of FIG. 2 comprises a swirl injector; however, further embodiments of the rocket engine of the present invention include fuel elements that comprise a shear coaxial injector annulus that does not swirl the fuel. The fuel element 54 of FIG. 2 is an annulus that defines a central axis that is substantially coaxial with the axis of the oxidizer element 40, such that the fuel element is annular and surrounds the oxidizer element. Conversely, the fuel element 154 of FIG. 3 defines a shape substantially similar to the oxidizer element 40 of FIG. 2, such that the oxidizer element 140 of FIG. 3 is annular and surrounds the fuel element. Still further embodiments of the present invention define the oxidizer element and fuel element in alternative configurations to mix the oxidizer and fuel. The mixture of oxidizer and fuel that is delivered to the combustion chamber is ignited to generate combustion gases for the generation of thrust. Further embodiments of the present invention deliver a mixture of oxidizer and fuel to generate combustion gases for non-thrust purposes, such as energy conversion purposes.

The fuel valves, fuel manifolds, and fuel elements of the rocket engines of the illustrated embodiments are configured to deliver a variety of fuels to the combustion chamber. For example, the rocket engine 30 of FIG. 2 may generate thrust in a first operational cycle using a first fuel, such as hydrogen, and then in an alternative second operational cycle using a second fuel, such as methane, and may further generate thrust in a third operational cycle using a third fuel, such as kerosene, to list non-limiting examples of alternative fuels. Therefore, the rocket engines of some embodiments of the present invention are not limited to only one specific type of fuel to allow more flexibility when refueling the rocket engine. The amount of oxidizer and fuel provided to the combustion chamber can also be controlled to maintain a substantially consistent mixture ratio of fuel and oxidizer at all power levels of the rocket engine for at least one of the first fuel or the second fuel. The amount of an oxidizer delivered to the oxidizer element is dependent upon the reaction chemistry of the fuel and oxidizer being delivered to the injector element, and processing circuitry is provided in some embodiments of the present invention to automatically control the oxidizer valve relative to the fuel valve, or vice versa, to provide a substantially consistent mixture ratio of fuel and oxidizer at the interface of the fuel and oxidizer for all power levels of the rocket engine. For example, relatively less oxidizer is provided to the oxidizer valve when used in combination with methane, whereas relatively more oxidizer is provided in combination with hydrogen at corresponding nominal operational conditions. Therefore, some embodiments of the present invention control the mixture ratio of fuel and oxidizer to improve the injector assembly performance for varying propellant combinations and operating conditions.

Referring again to FIG. 2, when the oxidizer valve 32 is positioned as illustrated in FIG. 2 the second oxidizer manifold 36 and third oxidizer manifold 38 are not delivered an oxidizer through the passage 33. However, during operation of the rocket engine, a lack of an oxidizer entering the respective manifold may give rise to an undesirable pressure differential that could create backflow into the manifold. Therefore, the rocket engine 30 of FIG. 2 includes a lift-off seal 70 that selectively engages the oxidizer valve to selectively allow an oxidizer to bleed into the second oxidizer manifold 36 and the third oxidizer manifold 38 to reduce or eliminate the undesirable pressure differential. The material separating the second and third oxidizer manifolds 34 and 36 of FIG. 2 provides a nominal gap at the interface with the oxidizer valve 32 to allow the bled oxidizer to pass to both the second and third oxidizer manifolds. The lift-off seal 70 comprises a ring of any material suitable for selectively sealing the valve, and the lift-off seal of FIG. 2 is linearly actuated using a bellow device; however, further embodiments of the present invention may include lift-off seals defining alternative shapes or materials and are actuated by alternative devices.

Referring now to FIG. 4, a filler fluid source 274 is provided to reduce or eliminate the undesirable pressure differential otherwise created when one or more of the oxidizer manifolds are not delivered an oxidizer. The filler fluid source 274 selectively fills an oxidizer manifold, such as the second oxidizer manifold 236 and the third oxidizer manifold 238 with a filler fluid which may comprise a gas, liquid, or combination thereof, may further comprise a combustible or non-combustible fluid, and may also comprise a continuous flow of filler fluid or a stagnant supply of filler fluid. One non-limiting example of a filler fluid is a vaporized oxidizer provided in a continuous flow sufficient to prevent backflow. The filler fluid advantageously prevents backflow from the oxidizer element into the respective oxidizer manifold. The filler fluid source 274 preferably includes a servo controlled valve 276 to selectively fill the oxidizer manifolds with the filler fluid. The position of the servo controlled valve 276 of the filler fluid source 274 of FIG. 4 is correlated to the position of the oxidizer valve 232 such that when the oxidizer valve closes the passage 233 to an oxidizer manifold, the servo controlled valve opens the passage to the respective oxidizer manifold to allow the filler fluid to fill the oxidizer manifold with a continuous flow of filler fluid or a stagnant supply of filler fluid. If a stagnant supply of filler fluid is provided, the oxidizer manifold retains a substantial portion the filler fluid until the oxidizer valve reopens the passage 233 to the respective oxidizer manifold, at which time the oxidizer expels the filler fluid through the oxidizer element 240 and into the combustion chamber. Still further embodiments of the present invention provide alternative and/or additional methods and devices for reducing or eliminating backflow into manifolds that are not receiving an oxidizer.

Embodiments of the present invention also provide methods of operating a rocket engine to allow throttling of the rocket engine with reduced the change in pressure drop across the oxidizer element and/or fuel element. One method of the present invention comprises delivering an oxidizer to two or more oxidizer manifolds and delivering a fuel to one or more fuel manifolds. As discussed above, the amounts of oxidizer and fuel delivered depend upon the type of fuel delivered to thereby maintain a substantially consistent mixture ratio of fuel and oxidizer at all power levels of the rocket engine. The oxidizer valve is selectively actuated to control delivery of the oxidizer into the oxidizer manifolds, through the oxidizer element, and into the combustion chamber. Similarly, the fuel valve is selectively actuated to control delivery of the fuel into the fuel manifold, through the fuel element, and into the combustion chamber to allow the oxidizer to mix with the fuel. The oxidizer and/or the fuel may be swirled by the oxidizer element or the fuel element, respectively, prior to combining the oxidizer and fuel. The swirling of the oxidizer and/or fuel substantially atomizes the oxidizer or fuel to enable further mixing of the oxidizer and fuel. The mixture of oxidizer and fuel is then combusted to generate the thrust of the rocket engine.

In addition to providing the multiple oxidizer manifolds and/or fuel manifolds, embodiments of the present invention provide further methods for reducing or eliminating the change in pressure drop across the oxidizer element and/or fuel element during throttling of the rocket engine. When an oxidizer valve is positioned to prevent an oxidizer from entering at least one oxidizer manifold, the oxidizer manifold is selectively filled with filler fluid by actuating a servo controlled valve. An alternative method comprises moving at least one lift-off seal proximate the oxidizer valve and/or fuel valve when an oxidizer valve or fuel valve is positioned to prevent an oxidizer or fuel from entering an oxidizer manifold or fuel manifold to thereby allow a nominal amount of an oxidizer or fuel to bleed into the oxidizer manifold or fuel manifold, respectively.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Terms are used in a generic and descriptive sense and should not be used for purposes of limiting the scope of the invention except by reference to the claims and the prior art.

What is claimed is:

1. An injector assembly for the delivery of propellants to a combustion chamber, the injector assembly comprising:

an oxidizer element upstream of the combustion chamber for providing an oxidizer thereto;

a fuel element upstream of the combustion chamber for providing fuel thereto;

at least one oxidizer manifold in fluid communication with the oxidizer element, wherein the at least one oxidizer manifold is configured to deliver an oxidizer to the oxidizer element;

at least two fuel manifolds in fluid communication with the fuel element, wherein the at least two fuel manifolds are configured to deliver fuel to the fuel element; and a fuel valve positionable between two open positions to selectively provide fuel to one or more of the at least two fuel manifolds, when in the first open position the fuel valve provides fuel to fewer fuel manifolds than when in the second open position.

2. An injector assembly according to claim 1 wherein the oxidizer element and fuel element are substantially coaxial.

3. An injector assembly according to claim 2 wherein the oxidizer element is annular and surrounds the fuel element.

4. An injector assembly according to claim 1 wherein the fuel element comprises a swirl injector.

5. An injector assembly according to claim 1 wherein the fuel valve comprises an integral valve.

6. An injector assembly according to claim 1 wherein the fuel valve comprises a servo controlled valve.

7. An injector assembly according to claim 1, further comprising a lift-off seal that selectively engages the fuel valve.

8. An injector assembly according to claim 1 wherein the injector assembly comprises at least two oxidizer manifolds.

9. An injector assembly according to claim 1 wherein said fuel valve defines a generally circular cross-section with a passage therethrough, said fuel valve positionable to selectively provide fuel through said passage.

10. An injector assembly according to claim 9 wherein said fuel valve is rotatable to selectively position said passage to provide fuel to one or more of the at least two fuel manifolds.

11. An injector assembly for the delivery of propellants to a combustion chamber, the injector assembly comprising:

at least one oxidizer manifold configured to deliver an oxidizer to an oxidizer element, said oxidizer element upstream of the combustion chamber and downstream of said at least one oxidizer manifold to provide oxidizer to the combustion chamber;

at least two fuel manifolds configured to deliver fuel to a fuel element, said fuel element upstream of said combustion chamber and downstream of said at least two fuel manifolds to provide fuel to the combustion chamber; and a fuel valve positionable between two open positions to provide fuel to one or more of the at least two fuel manifolds, when in the first open position the fuel valve provides fuel to fewer fuel manifolds than when in the second open position.

* * * * *